US005467721A

United States Patent [19]

Gosch

[11] Patent Number: 5,467,721

[45] Date of Patent: Nov. 21, 1995

[54] VERTICALLY MOVABLE TABLE

[75] Inventor: Richard H. Gosch, Westchester, Ill.

[73] Assignee: Motorola, Inc., Schaumburg, Ill.

[21] Appl. No.: 61,371

[22] Filed: May 14, 1993

[51] Int. Cl.[6] ..... A47B 9/00

[52] U.S. Cl. ..... 108/146; 108/144

[58] Field of Search ..... 108/110, 146, 108/148, 144; 297/410; 248/407, 408, 409, 423

[56] References Cited

U.S. PATENT DOCUMENTS

| | | | |
|---|---|---|---|
| 359,340 | 3/1887 | Zaccone | 108/146 |
| 888,754 | 5/1908 | Schuff | 108/146 |
| 979,149 | 12/1910 | Gay | 297/356 |
| 1,888,478 | 11/1932 | Steidl | 108/146 X |
| 3,327,988 | 6/1967 | Levit et al. | 108/146 X |

*Primary Examiner*—Jose V. Chen
*Attorney, Agent, or Firm*—Steven G. Parmelee

[57] ABSTRACT

A table surface (11) adjusts in set increments to a variety of vertical positions. The table surface (11) moves only in a vertical direction, as determined through use of a vertical guide (16) that traverses a vertical tract (15). A tooth (35) and pawl (40) assembly controls the vertical disposition of the assembly such that the table surface (11) is incrementally raised to different vertical positions of choice. Once the table surface (11) has been raised to its uppermost limit, the pawl (40) becomes locked in a non-tooth engaging position, thereby allowing the table surface (11) to be lowered to its lower most position. When so lowered, the pawl (40) is released from its non-engaging position, such that the pawl (40) again engages the teeth (35) to allow the table surface (11) to be incrementally raised as before.

4 Claims, 4 Drawing Sheets

VERTICALLY MOVABLE TABLE

TECHNICAL FIELD

This invention relates generally to table surfaces.

BACKGROUND OF THE INVENTION

Tables are well understood in the art, and are used for a multitude of purposes. Some tables represent work surfaces at which an individual accomplishes work while using one or more items located on the table surface. Typically, the height of such a table surface is relatively fixed with respect to the floor. Some minor adjustments may be possible when initially installing or constructing the table surface, but thereafter, the table height is not readily alterable during use.

The above situation presents a problem to persons having non standard physical conditions. For example, many table heights considered normal are too low to readily accommodate an individual in a wheelchair. By the same token, many such table surfaces are also too high to readily accommodate a person of diminutive stature.

A person having special physical requirements can of course make use of custom made or custom adjusted furniture. Such a prior art solution does not work well, however, when the table surface in question must be shared with others having differing needs. For example, radio communication systems dispatchers as employed by various public safety agencies often work in shifts, with different people occupying the same work area during the course of the day. It can be a significant burden to such an organization to provide customized furniture for each of their employees.

Consequently, a need exists for a table that will readily and easily accommodate a variety of users having differing physical requirements. Preferably, such a table would require only a minimum of effort to achieve the customizing, as well as a minimum of strength and expertise. And, of course, such a table should not be expensive to obtain or complicated to maintain.

DESCRIPTION OF A PREFERRED EMBODIMENT

In general, the present invention embodies a table that readily and easily conforms to a user's preference in terms of height. The table's surface, coupled to a mechanical assembly, allows adjustments of its height level for comfortable usage. Any table surface can be accommodated using the assembly, depending on the load supportable by the mechanical assembly. A detailed explanation will now follow regarding this table surface and its height adjusting mechanism.

Figure 1:
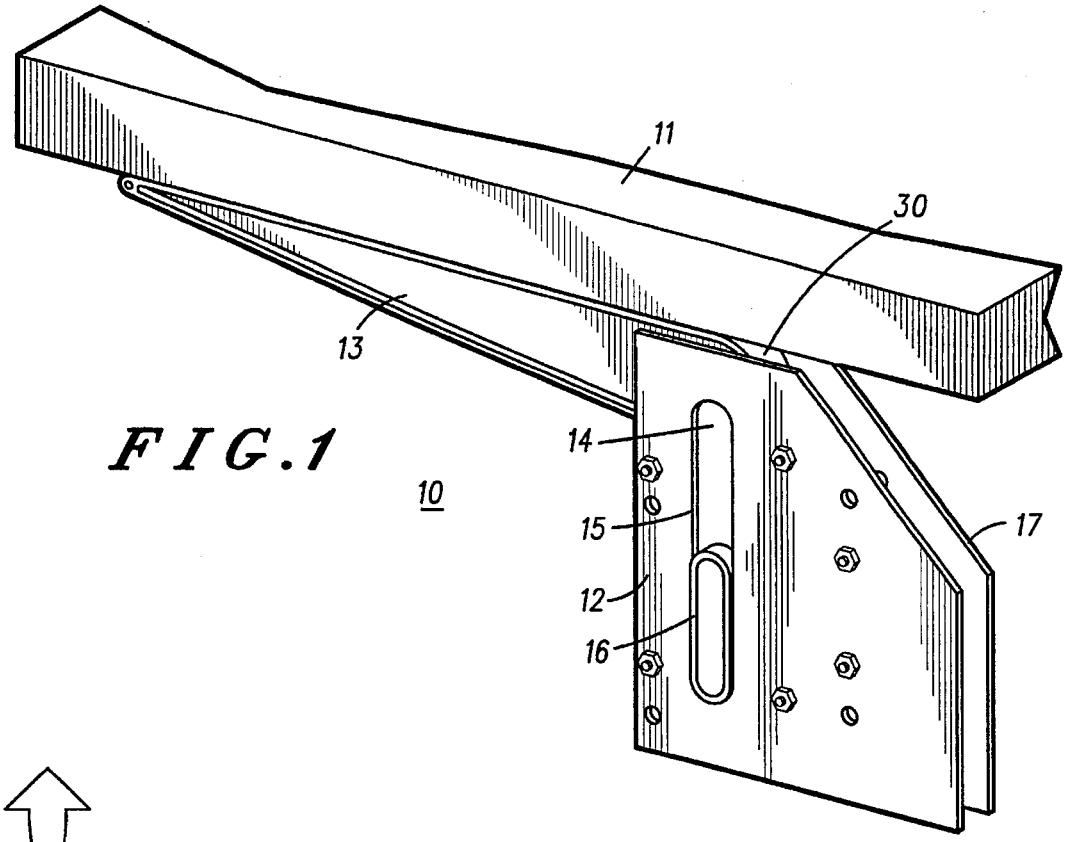
FIG. 1 illustrates a perspective of the lowermost vertical position of an adjustable table in accordance with the present invention.

FIG. 1 illustrates a table (10) that comprises a substantially planar, horizontal table surface (11) coupled to a plastic L-shaped member (30) consisting of two legs (13 and 14). The horizontal leg (13) couples to the table surface (11) and the vertical leg (14) fits between two metal mounting plates (12 and 17). One mounting plate (12) is shown with an oval-shaped vertical track (15) which limits the movement of a vertical guide (16). The other mounting plate (17) also has a vertical track but that is not shown in the illustrations.

Figure 2:
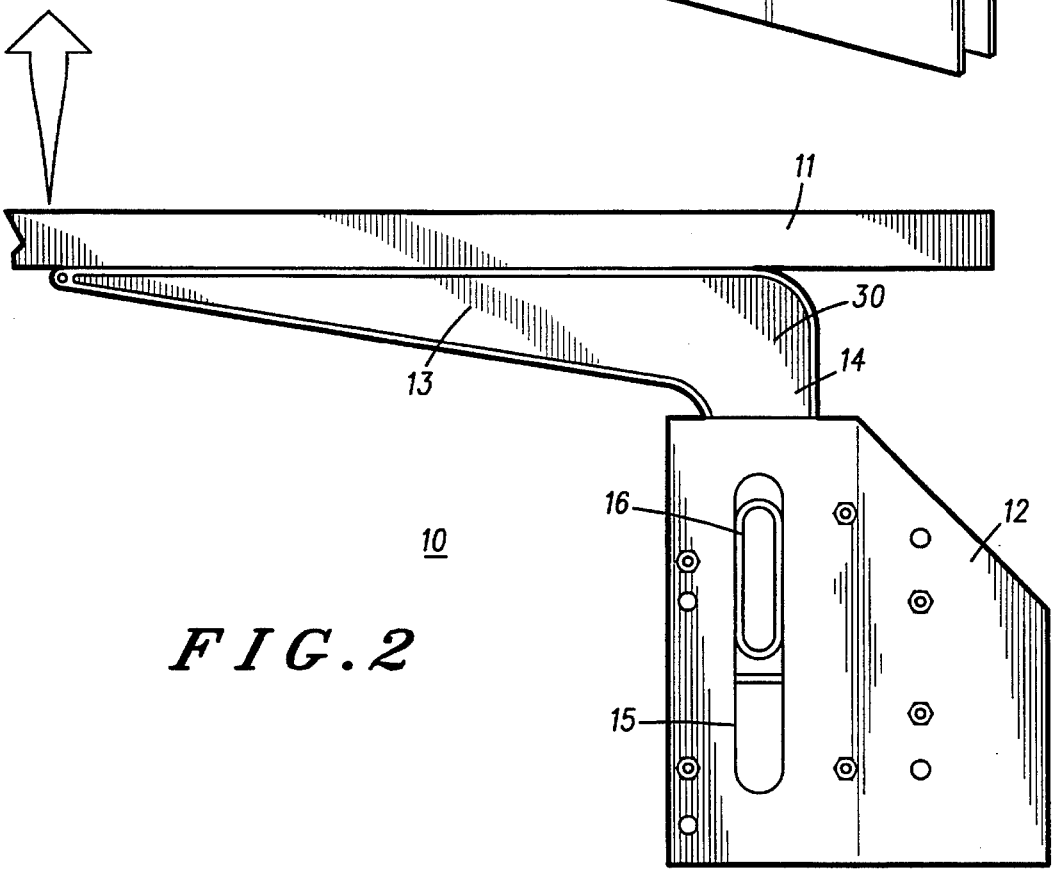
FIG. 2 illustrates the uppermost vertical position of an adjustable table in accordance with the present invention.

The table surface (11) is movable only in two substantially vertical directions. In a first vertical direction, upwards, the table surface (11) moves from its lowermost vertical position to its uppermost vertical position in affixed incremental steps. FIG. 1 and FIG. 2 illustrate the lowermost and uppermost vertical positions of the table surface (11) respectively. In a second vertical direction, downwards, the table surface (11) moves from its uppermost vertical position to its lowermost vertical position. This vertically downward direction is possible only after the table surface (11) reaches its uppermost vertical position. Details of both movements requires a physical understanding of the L-shaped member (30) shown in FIG. 3, and its interactions with a mechanical assembly within the mounting plates (12 and 17).

Figure 3:
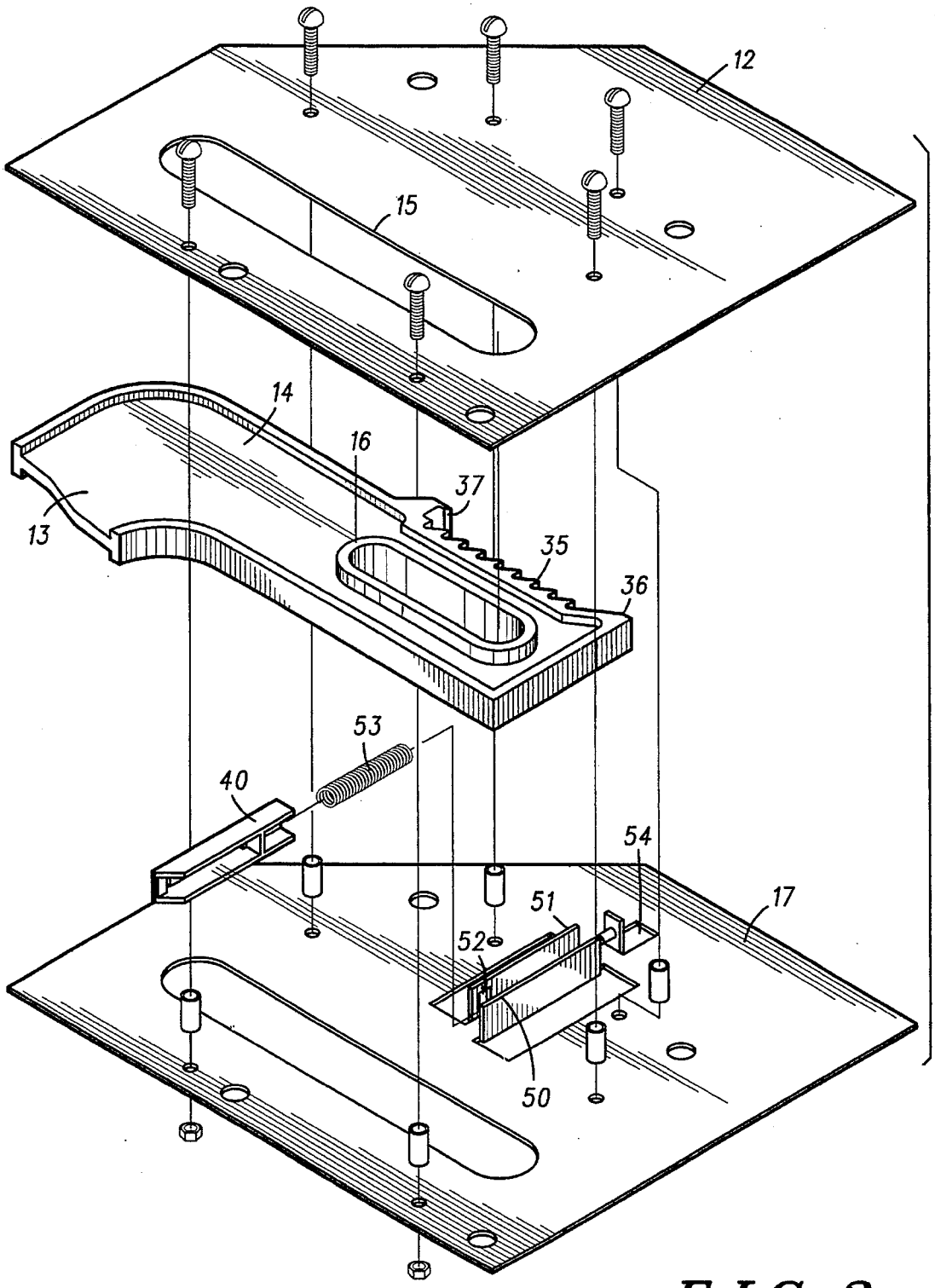
FIG. 3 illustrates an exploded perspective view of two mounting plates and an L-shaped member in accordance with the present invention.

FIG. 3 shows a perspective view of the L-shaped member (30) comprising the vertical guide (16), a plurality of teeth (35), a cam end (36), and a release trigger (37). In this embodiment, all these are integral parts of the L-shaped member (30). The vertical guide (16) is formed by an oval-shaped protrusion from the vertical leg (14). When the vertical guide (16) sits into the oval groove of the vertical track (15), movement of the L-shaped member (30) is restricted along the axis of the vertical track (15). In addition, the two rounded ends of the vertical track (15) determine the uppermost and lowermost vertical positions of the L-shaped member, and correspondingly, the table surface (11).

The incremental upward movement of the vertical leg (14) results from the interactions of the ratchet teeth (35), cam end (36), and release trigger (37) with a pawl that is movably disposed with respect to the mounting plates (12 and 17). To understand this incremental movement, an introduction to a pawl is necessary.

Figure 4:
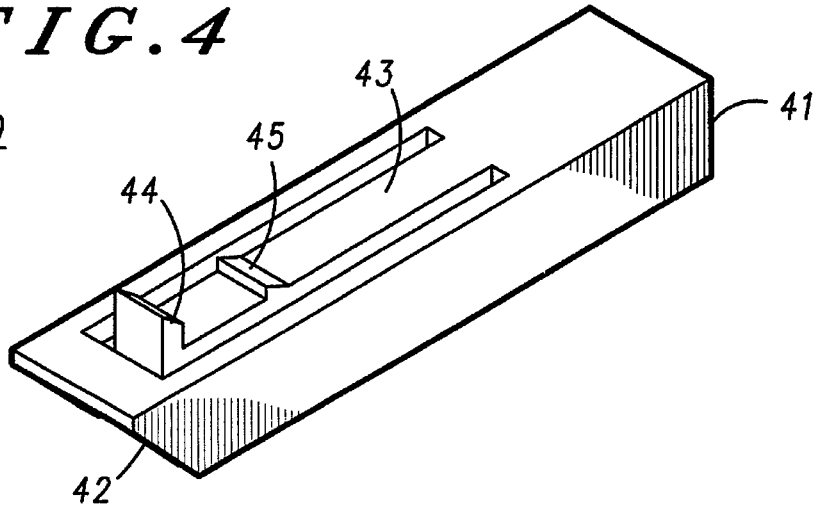
FIG. 4 illustrates a perspective view of a pawl of the adjustable table in accordance with the present invention.
Figure 5:
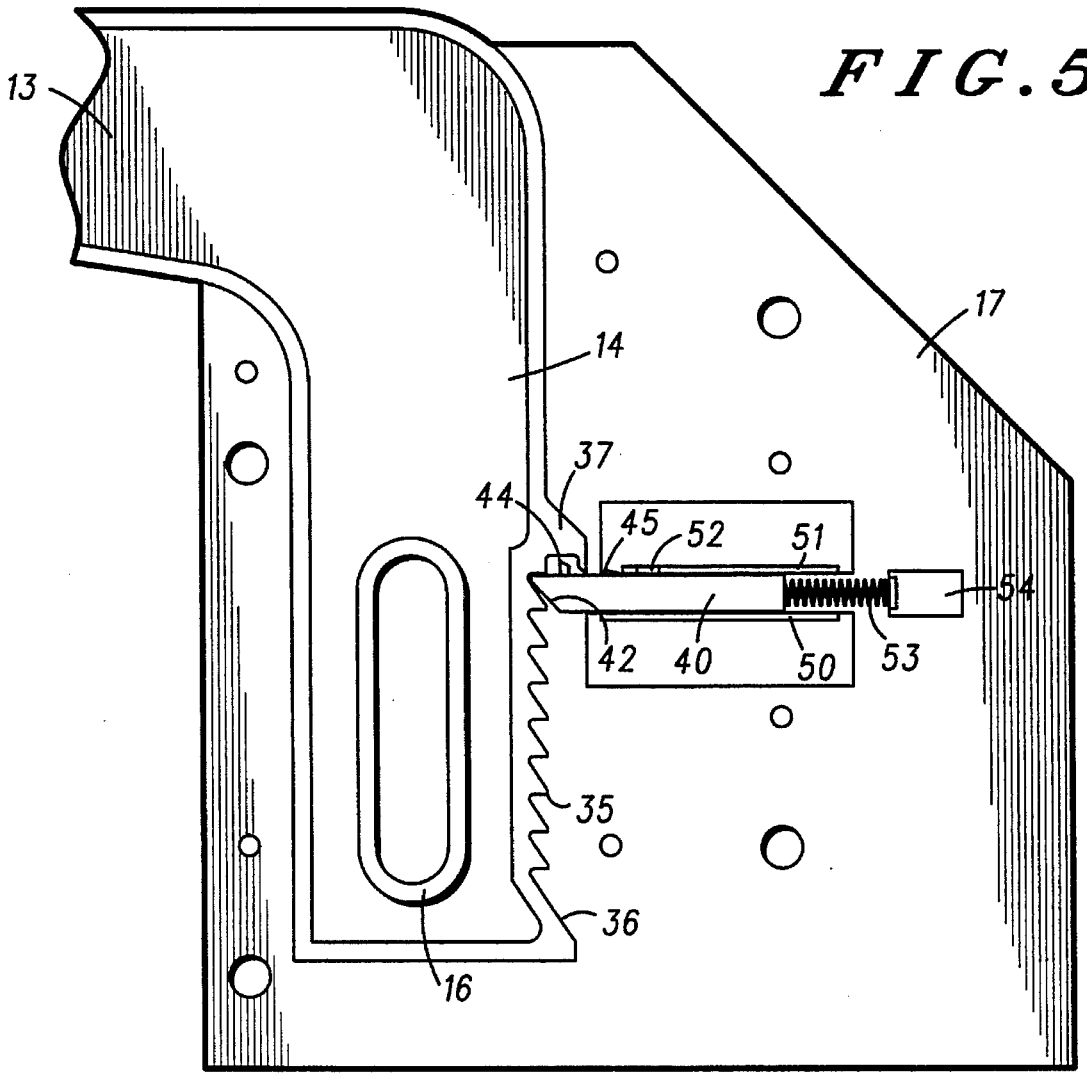
FIG. 5 is a side view of the pawl assembly and an L-shaped member with the adjustable table in the lowermost vertical position.

FIG. 4 shows a perspective view of a pawl (40), made of plastic, and comprises a cantilevered spring (43), a release pad (44), and a catch (45). As illustrated in FIG. 5, the pawl (40) fits between two pawl guide surfaces (50 and 51) that are formed from one of the mounting plates (17). A gear assembly, comprising the ratchet teeth (35) and the pawl (40), controls the variously affixed vertical positions of the L-shaped member (30), and hence, the table surface (11). Starting with the vertical leg (14) at its lowermost vertical position, as shown in FIG. 5, the pawl bevel (42) engages the topmost ratchet tooth. This topmost ratchet tooth is just below the release trigger (37) of the vertical leg (14). A pawl spring (53) exerting a force on the pawl (40) causes this engagement. The pawl spring (53) is fixed onto a metal brace (54) on the mounting plate (17), and runs along a pawl spring groove (41) formed in the pawl (40).

When an upward lift of the table surface (11) occurs, the topmost ratchet tooth moves upwards as well. This movement also pushes the pawl (40) laterally backwards. If sufficient upward movement is attained, the second topmost ratchet tooth is engaged by the pawl (40). Otherwise, the pawl (40) locks onto a ratchet tooth on the same horizontal level, and holds the L-shaped member (30) at a fixed vertical position. Continual upward movement of the table surface (11) causes the other lower ratchet teeth (35) to be consecutively engaged. What happens when the vertical leg reaches the lowermost ratchet tooth is explained using FIGS. 6 & 7.

Figure 7:
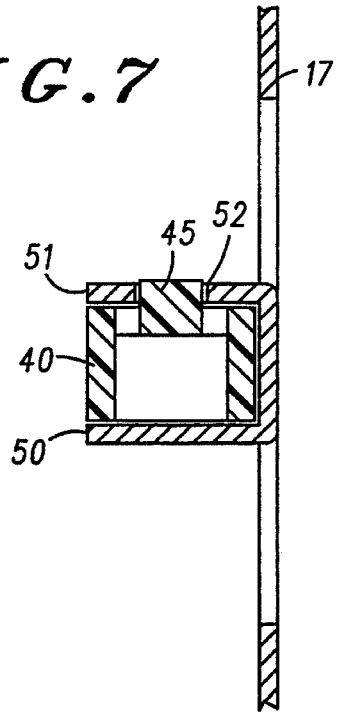
FIG. 7 is a partial cross-sectional view of the pawl assembly taken along line 7—7 in FIG. 6.
Figure 6:
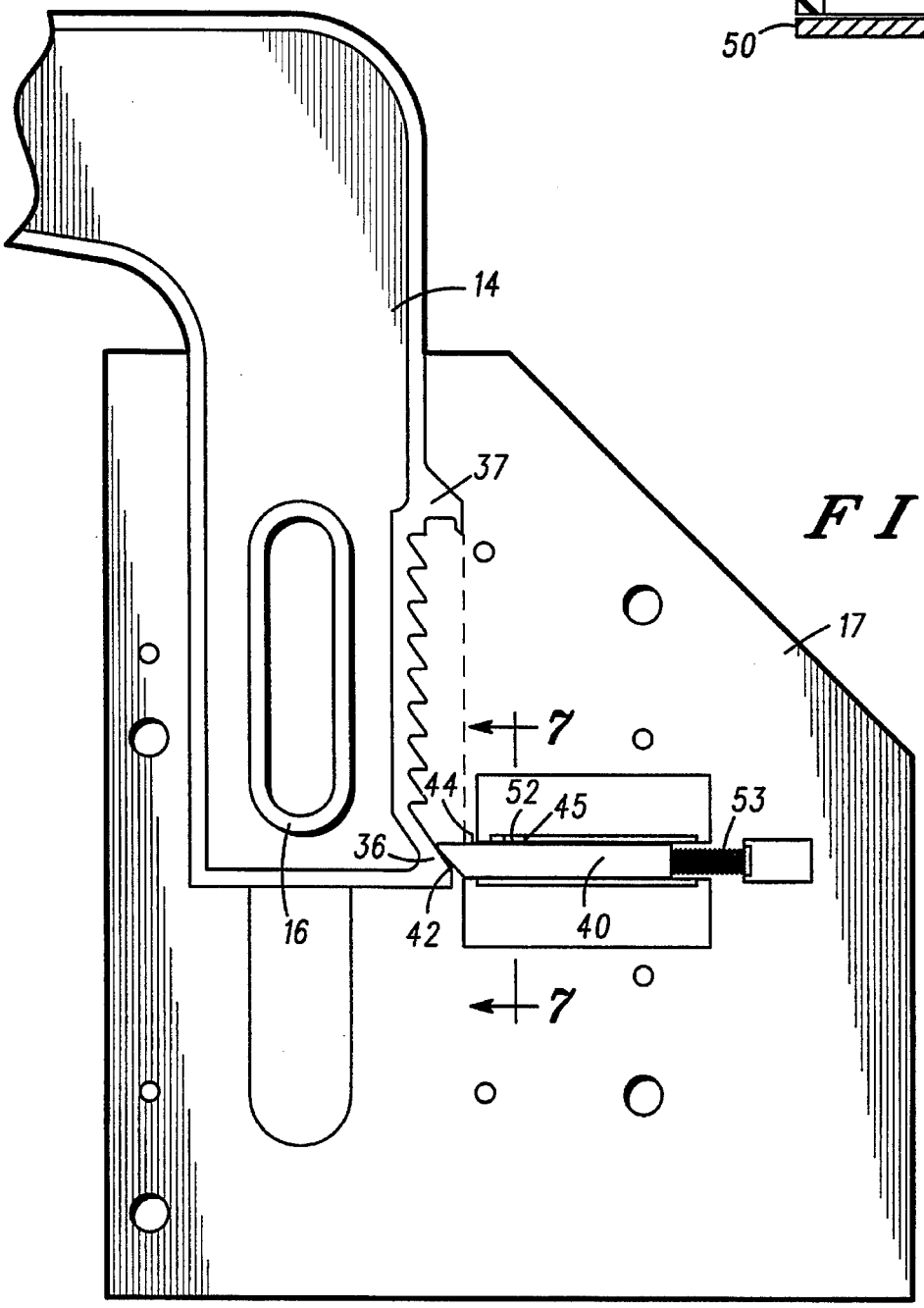
FIG. 6 is a side view of the pawl assembly and the L-shaped member with the adjustable table in the uppermost vertical position.

FIG. 6 shows the pawl (40) and the vertical leg (14) of the L-shaped member (30) when the table surface (11) reaches its uppermost vertical position. At this position, the cam end (36) on the vertical leg (14) pushes the pawl (40) further back such that the catch (45) on the pawl (40) locks into a notch (52) located on the upper pawl guide surface (51). When this occurs, the pawl (40) disengages fully from the ratchet teeth (35), and the table surface (11) moves freely, in a substantially vertical direction, within the limits imposed by the vertical track (15). FIG. 7 illustrates the catch (45) locking into the notch (52) as a cross-sectional view along line 7—7.

If the table surface (11) drops to its lowermost vertical position during this freely moving period, the release trigger (37) depresses the release pad (44). This causes the cantilevered spring (43) to lower and, at the same time, unlock the catch (45) from the notch (52). Unlocking the catch (45) brings the gear assembly back to its original state, wherein the pawl (40) locks onto the topmost ratchet tooth. The table surface (11) is once again ready for any incremental, vertically upward adjustments.

A table surface incorporated with the above features allow users to easily adjust table heights in a cost effective manner without using any additional tools. The present invention also saves time and effort. In addition, the present invention saves space. Further, the present invention is not physically demanding to adjust and, as such, can be effected by users with minor physical impairments or restrictions, so long as they are able to lift the table surface vertically upwards, with or without any load(s) on the table surface.

What is claimed is:

1. An adjustable table surface comprising:

A) a table surface;

B) an L-shaped member having:

one leg coupled to the table surface; and a second leg having;

a vertical guide attached thereto;

ratchet teeth attached thereto;

a cam surface; and a release trigger;

C) a support surface having:

a vertical track having the vertical guide disposed therein; and pawl guide surfaces, wherein at least one pawl guide surface includes a first catch;

D) a pawl supported and guided by the pawl guide surfaces and being arranged and configured to interact with the ratchet teeth to form a ratchet such that the table surface is moveable in a first direction to a plurality of fixed vertical positions, wherein the bawl includes a second catch and a release pad; and such that the first and second catch will interact when the cam surface urges the pawl to a first position, thereby holding the pawl in a locked position that prevents interaction of the pawl with the ratchet teeth, and when the release trigger contacts the release pad, the first and second catch are disengaged from one another, thereby releasing the pawl from the locked position.

2. The adjustable table surface of 1, wherein the first catch comprises a slot formed in one of the pawl guide surfaces.

3. The adjustable table surface of 2, wherein the second catch comprises a tab that fits within the slot.

4. The adjustable table surface of claim 1, wherein the release trigger is positioned such that the release trigger contacts the release pad when the adjustable table surface has been moved to its lowest vertical position.

* * * * *